US007159743B2

(12) United States Patent
Brandt et al.

(10) Patent No.: US 7,159,743 B2
(45) Date of Patent: Jan. 9, 2007

(54) DEVICE FOR INJECTING ADDITIVE FLUIDS INTO A PRIMARY FLUID FLOW

(75) Inventors: Kevin Brandt, Barrington, IL (US); Scott Sevcik, Crystal Lake, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 0 days.

(21) Appl. No.: 10/938,329

(22) Filed: Sep. 10, 2004

(65) Prior Publication Data

US 2005/0067433 A1 Mar. 31, 2005

Related U.S. Application Data

(60) Provisional application No. 60/506,391, filed on Sep. 27, 2003.

(51) Int. Cl.
*B67D 5/52* (2006.01)

(52) U.S. Cl. ..... 222/135; 222/145.1; 222/129.1

(58) Field of Classification Search ..... 222/135, 222/132, 144.5, 145.1, 145.7, 129.1, 129.3, 222/129.4
See application file for complete search history.

(56) References Cited

U.S. PATENT DOCUMENTS 1,758,552 A * 5/1930 Allen et al. ..... 239/305
2,680,802 A * 6/1954 Bremer et al. ..... 392/321
3,423,028 A * 1/1969 Stupakis ..... 239/427.3
3,460,717 A * 8/1969 Thomas ..... 222/129.1
3,945,614 A * 3/1976 Suzuki et al. ..... 366/181.6
4,917,502 A * 4/1990 Proksa et al. ..... 366/159.1
6,223,948 B1 * 5/2001 Davis ..... 222/132
6,419,120 B1 * 7/2002 Bertone ..... 222/129.4
2004/0040983 A1 * 3/2004 Ziesel ..... 222/129.1

* cited by examiner

*Primary Examiner*—Lien M. Ngo
(74) *Attorney, Agent, or Firm*—Pyle & Piontek

(57) ABSTRACT

A device for injecting additive fluids into a stream of a primary fluid as it passes through a common central bore is characterized by a series of specially formed layers each having a particular fluid flow pattern formed therein. The layers are registered one above the other and sandwiched together to form an integral unit in which there are separate fluid flow channels for each of a desired number of additive fluids. Each channel has an inlet for receiving fluid from an associated pressurized source and a plurality of outlets terminating in angularly spaced relationship around an interior perimeter surface of the common bore. A selection mechanism provides for choosing a desired additive fluid for injection into the primary fluid in a manner coordinated with the flow of the primary fluid through the common bore.

18 Claims, 5 Drawing Sheets

DEVICE FOR INJECTING ADDITIVE FLUIDS INTO A PRIMARY FLUID FLOW

This application claims benefit of provisional application Ser. No. 60/506,391, filed Sep. 27, 2003.

FIELD OF THE INVENTION

The present invention relates generally to beverage dispensing equipment, and in particular to specialized nozzles used in beverage dispensing equipment to provide for additive flavors, coloring and the like.

BACKGROUND OF THE INVENTION

Fountain beverage dispensing equipment is well known in the art and includes various types of machines for dispensing liquid drinks and for making and dispensing slush ice drinks as well. Typically, drinks are dispensed from one or more dedicated valves, each structured to dispense only a single flavor. In order to save space and cost, it is known to have multiple flavor valves that have the capacity to dispense a plurality of flavors from the same nozzle, but such valves dispense only one flavor at a time.

Various carbonated drinks, particularly cola drinks, have long been available, especially in bottled form with various flavorings such as cherry, vanilla and lemon added to the basic syrup formulation of the drinks. While additive flavors can be included in the syrup formulations as supplied to the drink retailer, such an approach increases the number of dedicated valves that are required. Thus, for example, in addition to a basic cola flavor and its diet counterpart, there would need to be separate valves for cherry and vanilla versions of each, and so on. This number can be increased further if caffeinated and non-caffeinated versions of the beverages are desired. The problem becomes particularly acute for slush ice or so-called frozen carbonated beverage "FCB" dispensing equipment, which typically can only serve two or four flavors per machine and where the cost per flavor is considerably higher than with liquid beverage dispensing equipment.

Accordingly, it would be desirable to have a mechanism for optionally adding a flavor or flavors to a base drink in such manner that the number of valves, and hence the complexity and cost of the beverage dispensing equipment, can be reduced.

SUMMARY OF THE INVENTION

In accordance with the present invention, a device for injecting additive fluids into a stream of a primary fluid comprises a body having a central bore for flow therethrough of the stream of primary fluid, and a plurality of separate fluid flow channels extending through the body. Each fluid flow channel has an inlet for connection to an associated supply of additive fluid and a plurality of outlet orifices opening into the central bore for emission from the outlet orifices of additive fluid from the associated supply and for direction of the emitted additive fluid into the stream of primary fluid flowing through the central bore.

In accordance with another aspect of the apparatus of the invention, a beverage dispenser comprises a beverage dispensing valve having a nozzle for dispensing a stream of a beverage from the nozzle; and a device for injecting additive fluid flavorings into the stream of beverage. The device comprises a body having a central bore for flow therethrough of the stream of beverage dispensed from the nozzle and a plurality of separate fluid flow channels extending through the body. Each fluid flow channel has an inlet for connection to an associated supply of additive fluid flavoring and a plurality of outlet orifices opening into the central bore for emission from the outlet orifices of additive fluid flavoring from the associated supply of additive fluid flavoring and for direction of the emitted additive fluid flavoring into the stream of beverage flowing through the central bore.

The invention also contemplates a method of injecting additive fluids into a stream of a primary fluid. The method comprises the steps of providing a body having a central bore; forming a plurality of separate fluid flow channels extending through the body, such that each fluid flow channel has at one end an inlet and at an opposite end a plurality of outlet orifices opening into the central bore; and fluid coupling the inlet to each channel to an associated supply of additive fluid. Also included are the steps of flowing the stream of primary fluid through the central bore; in response to performance of the flowing step, delivering additive fluid from a selected supply thereof to the inlet to the associated channel for flow of the additive fluid through the channel and emission from the outlet orifices from the channel; and directing the additive fluid emitted from the outlet orifices into the stream of primary fluid flowing through the central bore.

In accordance with another aspect of the method of the invention, additive fluid flavorings are injected into a stream of a beverage dispensed from a nozzle of a beverage dispensing valve of a beverage dispenser. In this aspect of the invention, the method comprises the steps of providing a body having a central bore; forming a plurality of separate fluid flow channels extending through the body, such that each fluid flow channel has at one end an inlet and at an opposite end a plurality of outlet orifices opening into the central bore; and fluid coupling the inlet to each channel to an associated supply of additive fluid flavoring. Also included are the steps of operating the beverage dispensing valve to flow a stream of the beverage through the central bore; in response to performance of the operating step, delivering additive fluid flavoring from a selected supply thereof to the inlet to the associated channel for flow of the additive fluid flavoring through the channel and emission from the outlet orifices from the channel; and directing the additive fluid flavoring emitted from the outlet orifices into the stream of beverage flowing through the central bore.

BRIEF DESCRIPTION OF THE DRAWINGS

A better understanding of the structure, operation and function of the present invention and the various objects and advantages thereof can be had by reference to the following detailed description which refers to the following figures wherein.

DETAILED DESCRIPTION

Figure 1:
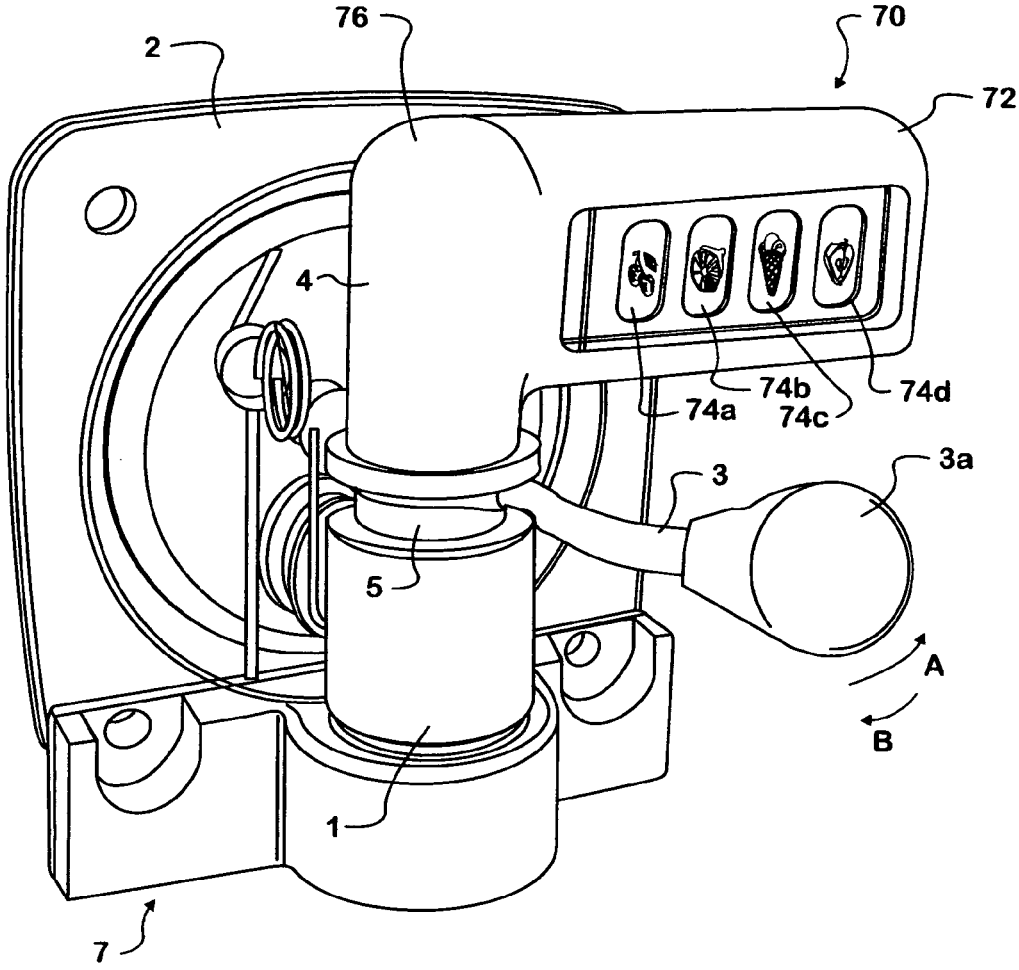
FIG. 1 shows a pictorial view of the multi-flavor injection device of the present invention as secured to a dispensing valve of a slush ice dispensing machine.
Figures 4A, 4B:
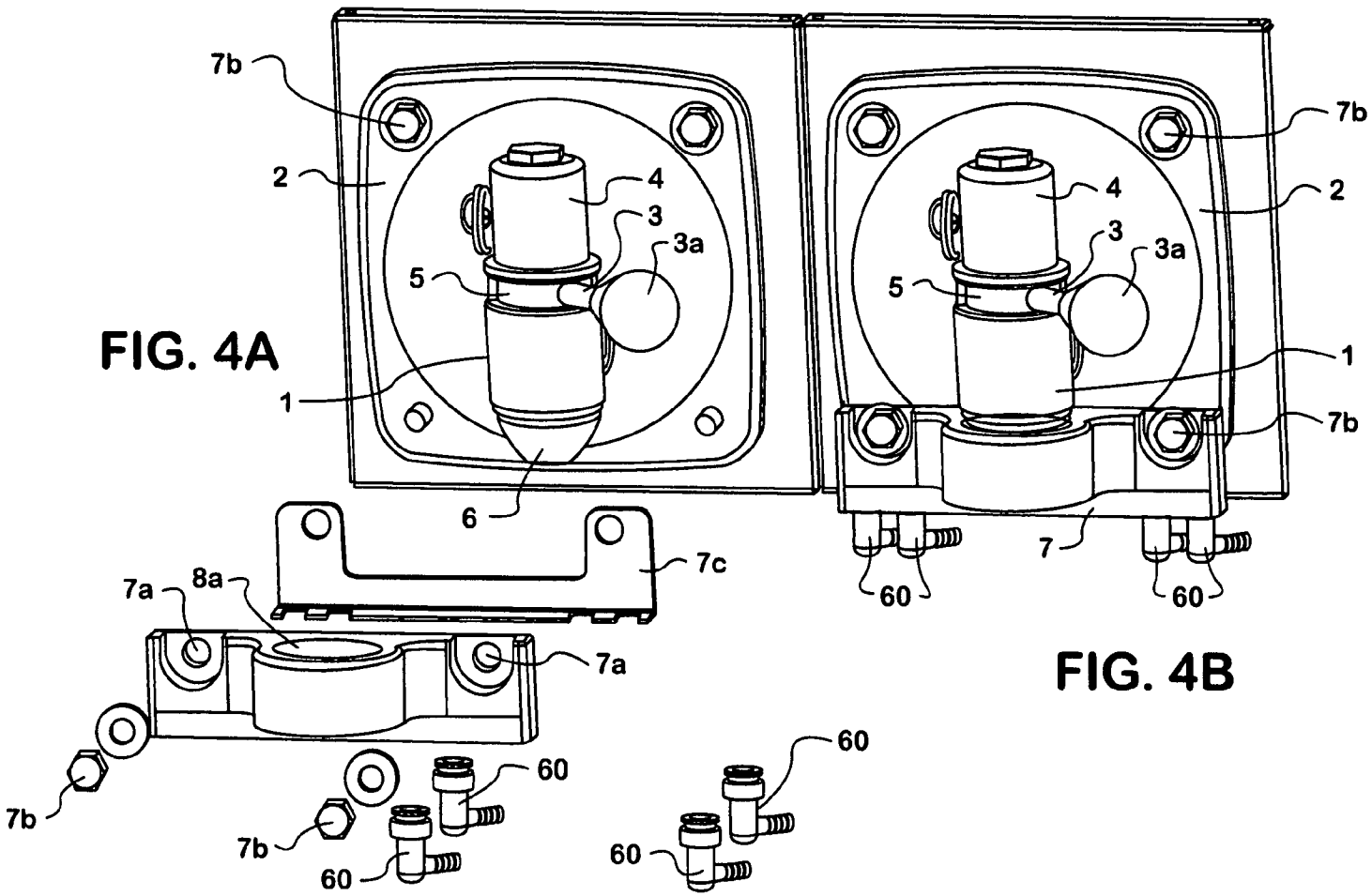
FIG. 4A shows a perspective exploded assembly view of a standard slush ice machine dispensing valve together the multi-flavor injection device.
FIG. 4B shows a perspective view of the standard slush ice machine dispensing valve having the injection device secured thereto.

The multi-flavor injection device of the invention will be described for use in connection with a slush ice beverage dispensing machine. As is understood, a slush ice dispensing valve, generally indicated at 1 in FIGS. 1, 4A and 4B, is secured to a face plate 2 on a front surface of a slush ice beverage dispensing machine. Face plate 2, as is well known, covers and encloses an open end of a refrigerated freeze cylinder, not shown, in which cylinder a slush ice beverage is prepared and stored for dispensing. Dispensing of the slush ice beverage is achieved by operation of valve 1, wherein an arm 3 of the valve, having an operating handle 3*a*, is manually rotated in the direction of an arrow A. Arm 3 operates against the tension of a spring (not shown) located in a spring housing 4 and is moved in a movement limiting slot 5 to cause a valve mechanism (not shown) to open, thus resulting in a slush beverage flowing out of a dispensing nozzle 6 and into a cup positioned below the nozzle. When the cup is full arm 3 is released by the user and spring tension then moves the arm in the direction of an arrow B to an off position of slush ice dispensing valve 1, resulting in the closing of the valve mechanism.

Figure 2:
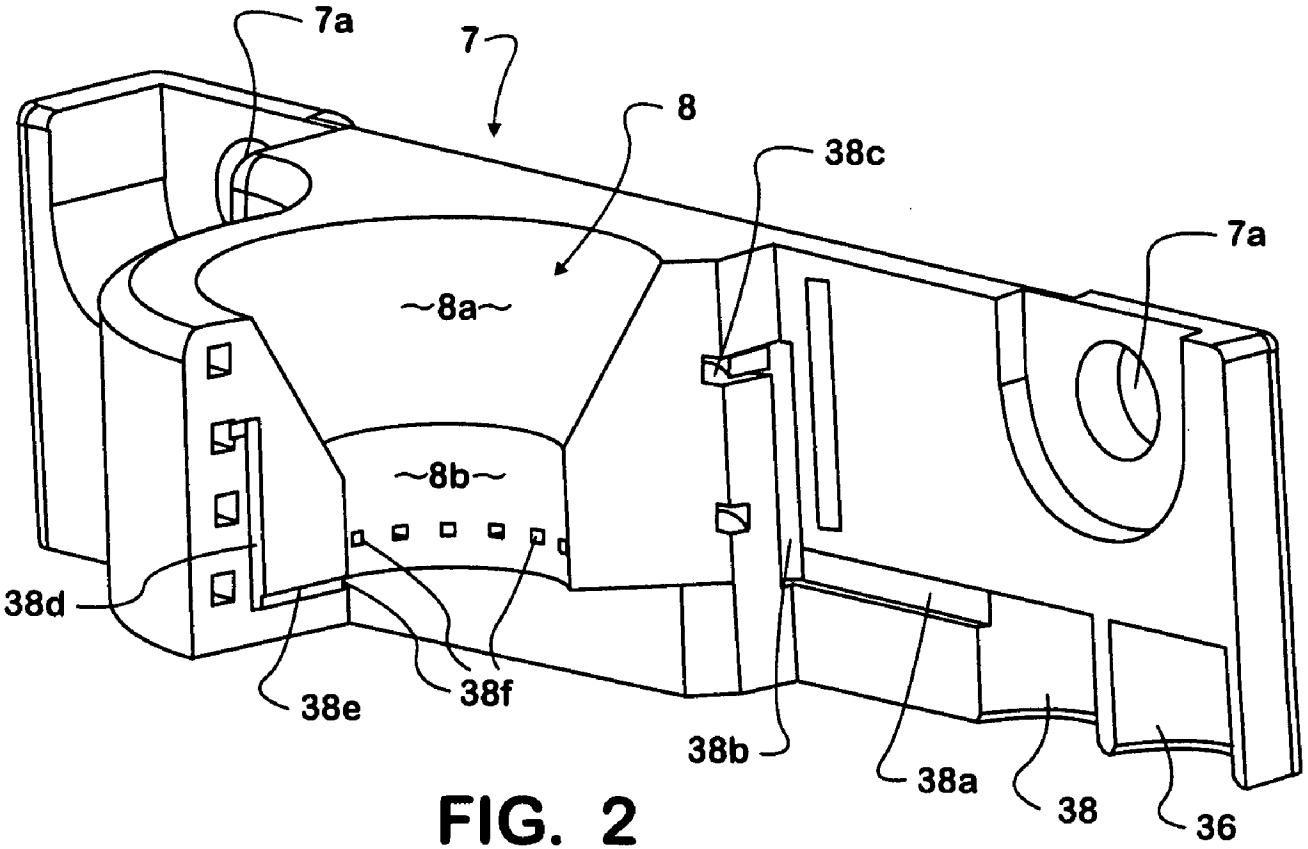
FIG. 2 shows an enlarged perspective cross-sectional view of the multi-flavor injection device.
Figure 3:
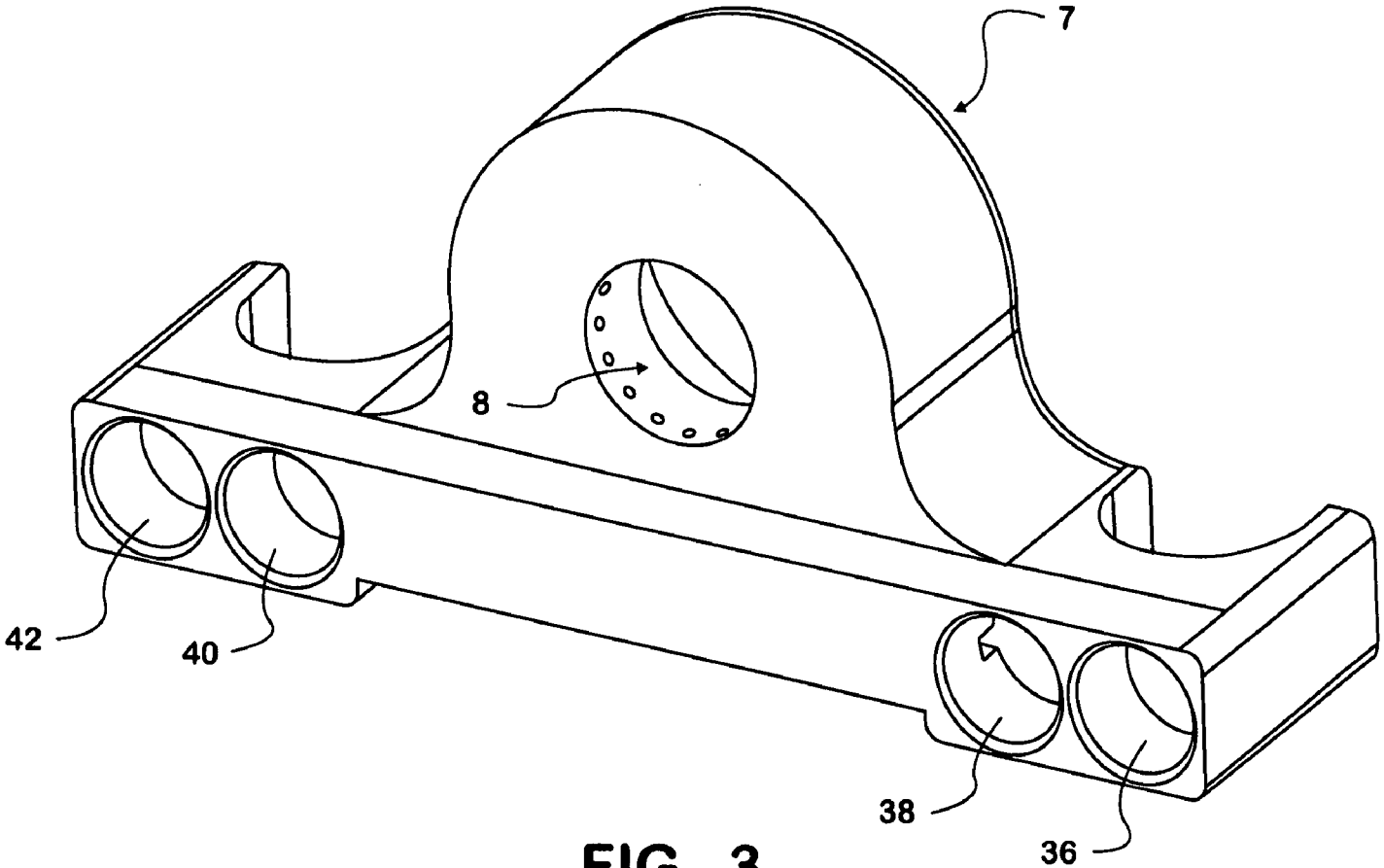
FIG. 3 shows an enlarged perspective bottom view of the multi-flavor injection device.

With reference also to FIGS. 2 and 3, the flavor injection assembly of the invention is adapted to secure to and work with a standard slush dispensing valve 1. The flavor injection assembly includes an injection device 7 having holes 7*a* through which two of four bolts 7*b* extend to secure injection device 7 and face plate 2 to the slush beverage dispensing machine, with the bottom two bolts securing injection device 7 and its mounting plate 7*c* to face plate 2. Injection device 7 includes a vertically extending flavor injection channel 8 having an enlarged frustoconical shaped top passage portion 8*a* and a lower cylindrical shaped passage portion 8*b*. Cylindrical passage portion 8*b* includes sixteen flavor injection outlets or orifices extending around a level perimeter therein.

Figure 5:
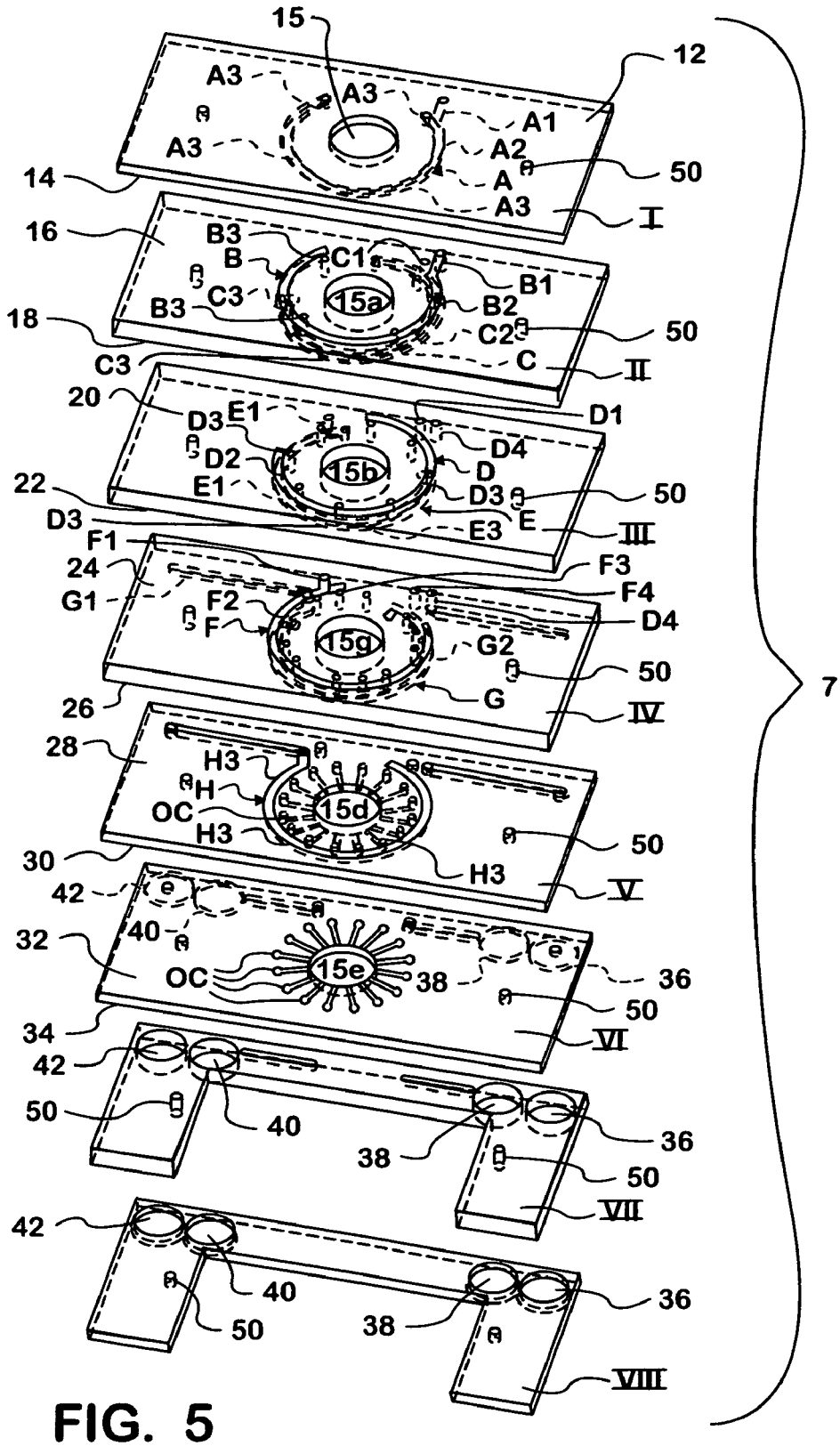
FIG. 5 shows an exploded view of the layered structure of the multi-flavor injection device.

Referring also to FIG. 5, the injection device 7 of the invention is comprised of eight generally planar plates or layers I–VIII that are sandwiched together to form injection device 7. Layer I has a top surface 12, a bottom surface 14 and a central nozzle receiving and product flow passage portion 15 that extends vertically therethrough and forms a portion (the uppermost portion) of injection passage 8 extending through injection device 7. Formed into bottom surface 14 of layer I is a first flavor flow channel portion A that includes an inlet portion A1, a partial circumferential channel portion A2 and four outlet channels A3.

Layer II is thicker than layer I as it includes fluidly separate channel portions formed into both top and bottom surfaces thereof as well as a central nozzle receiving and product flow passage portion 15*a* that extends vertically therethrough and, along with the passage portion 15, forms a portion of flavor injection channel or passage 8 of flavor injection device 7. A top surface 16 of layer II includes a first flavor flow channel "half" B that is complementary in shape and corresponds to and is a mirror image of flavor channel A formed in bottom surface 14 of layer I, so that when layers I and II are brought or sandwiched together channels A and B register with each other. First flavor flow portion B thus includes a corresponding inlet portion B1, a partial circumferential portion B2 and four outlet channels B3 extending vertically through layer II. A bottom surface 18 of layer II includes a partial second flavor flow channel C formed therein. Channel C includes an inlet portion C1, a partial circumferential channel portion C2 and four outlet channels C3.

A corresponding bottom second flavor flow channel "half" D of second flavor flow channel portion C is formed in a top surface 20 of layer III and includes an inlet portion D1, a partial circumferential channel portion D2 and four outlet channels D3. Second flavor flow channel portion D also includes a vertical first flavor inlet channel D4 extending through layer III. A third flavor flow channel portion E is formed into a bottom surface 22 of layer III. Channel portion E includes an inlet portion E1, a partial circumferential channel portion E2 and four outlet channels E3. Layer III also includes a central nozzle receiving and product flow passage portion 15*b* that extends vertically therethrough and, along with the passage portions 15 and 15*a*, forms a portion of flavor injection channel or passage 8 for receiving dispenser nozzle 6.

In a similar manner, a corresponding third flavor flow channel half F of flavor flow channel E is formed in a top surface 24 of layer IV and includes an inlet portion F1, a partial circumferential channel portion F2 and four outlet channels F3. Third flavor flow channel portion F also includes a vertical inlet channel F4 extending through layer IV. A fourth flavor flow channel portion G is formed into a bottom surface 26 of layer IV and also includes an inlet portion G1, a partial circumferential channel portion G2 and four outlet channels G3. Layer IV also includes additive fluid channel extensions of the various vertical outlets as well as a passage portion 15*c* of passage 8.

In a similar manner as described above, a corresponding channel "half" H of flavor channel G is formed in a top surface 28 of layer V and includes an inlet portion HI, a partial circumferential channel portion H2 and four outlet channels H3. Layer V further includes additive flavor outlet channels (not shown) formed in a bottom surface 30 thereof and each such outlet channel includes a vertical channel extending through layer V and including the channel extensions of the other outlets. Layer V further includes a passage portion 15*d* of passage 8.

A top surface 32 of layer VI includes complementary corresponding "halves" of outlet channels OC that cooperate with those of layer V. Layer VI also includes a central passage portion 15*e* that together with the corresponding passage portions 15 and 15*a*–15*d* in layers I–V create the central nozzle receiving and flow channel 8. Together, channel halves OC of layers V and VI create sixteen additive flavor channels terminating at the sixteen flavor injection orifices or outlets lying in a common plane in and extending around a level perimeter on the inner surface of cylindrical channel portion 8*b* of passage 8.

A bottom surface 34 of Layer VI also includes a first flavor inlet connector bore 36, a second flavor inlet bore 38, a third flavor inlet bore 40 and fourth flavor inlet bore 42. Layer VII includes four bores therethrough that comprise extensions of bores 36, 38 40 and 42 and are indicated like numerals. Layer VIII includes four further bores therethrough also comprising extensions of bores 36, 38 40 and 42 and also indicated by like numerals.

It is contemplated that adhesive be used to secure layers I–VIII together, so that all of the various channel portions fit together and form fluidly separate flow channels, although other suitable means may be used. It is important that these layers be sandwiched together in a manner that they register one on top of the other accurately, and to ensure accurate registration when the layers are sandwiched together registration holes 50 extend through each layer for receiving a pair of vertical registration pins. The registration pins may be firmly anchored in an assembly block and are used to provide for accurate assembly of the layers. After the layers have been glued together any excess material and glue are removed to produce the injector 7.

When the layers I–VIII are adhered together to form injection device 7, four fluidly separate flavor injection channels are formed and exist within the injection device. The first flavor injection channel is formed by the combination of channel portions A and B, the second flavor injection channel by the combination of channel portions C and D, the third by the combination of channel portions E and F and the fourth by the combination of channel portions G and H. Bores 36, 38, 40 and 42 receive respective inlet hose connectors 60 for each of four additive flavors that provide for connection of the bores to pressurized sources of additive flavors (not shown).

An exemplary view of the path traveled through injection device 7 by the various flavors 1–4 can be had by referring to FIG. 2 wherein the path in respect of additive flavor 3 is specifically shown. Additive flavor-3 enters the flavor 3 inlet port, i.e., the bore 38, and then flows through a flavor 3 passageway 38*a*, 38*b* to a flavor-3-ring 38*c*. Additive flavor-3 then flows around and through flavor 3 ring 38*c* and down four flavor 3 down tubes 38*d* to four flavor-3 outlet channels 38*e* from whence additive flavor-3 exits four outlet orifices or orifices 38*f* (only three outlets 38*f* are shown) into cylindrical passage portion 8*b*. It can be appreciated that the four outlet orifices for each of additive flavors 1–4 are positioned equidistant around passage portion 8*b*. At this point, the flavor additive ejected from the four outlet orifices 38*f* is directed into and joins the major flow of the particular frozen slush beverage as it flows through and out of central vertical passage or bore 8.

Referring again to FIG. 1, in use of the injection device 7 a flavor selection mechanism 70 is provided. Flavor selection mechanism 70 includes a horizontal housing portion 72 to which are mounted selection switches 74*a*, 74*b*, 74*c* and 74*d* corresponding to each of the four additive flavors. A vertical housing portion 76 is secured to and over spring housing 4 and includes a proximity sensor 78, indicated by dashed lines. Proximity sensor 78 is retained within housing 76 and senses when valve arm 3 is in the open position, as depicted in FIG. 1. A suitable electronic control is contained within housing portion 72 and is connected to switches 74*a*–*d* and proximity sensor 78. When a slush drink is to have a flavor additive, such for example as vanilla, lemon or cherry, the particular switch 74*a*–*d* corresponding to that flavor is first pressed. Arm 3 is then moved to open valve 1 and when arm 3 reaches the valve open position as sensed by proximity sensor 78, the control circuit operates a solenoid to cause a remote flavor additive valve to open. The flavor additive valves provide for delivery in an on/off manner flow of additive flavors from pressurized sources thereof. Once the remote flavor additive valve is opened, the selected flavor flows from the pressurized source thereof into, through and out of injection device 7 and into the stream of slush beverage as it flows through and is dispensed from the passage 8 in the injection device 7.

It is understood that while the injection device 7 of the present invention has been described for use with a slush beverage dispensing machine, that particular environment is intended to be merely illustrative of one of many potential applications for the invention. The injected additive flavor need not be a syrup, but could conceivably be any of a variety of liquids whether potable or not. In fact, the added substance could be a gas as well as a liquid. The present invention also is not limited to injection of just four additives to a fluid stream, but could be used to inject any desired number of additives. Further, more than one such injection device could be used, stacked one on top of the other in order to increase the number of additive fluids that can be injected into a common stream. The invention can also be used to simultaneously inject more than one additive at a time or, if desired, be used in a manner to stagger the injection of multiple different additives during dispensing of a primary fluid. The injection device could also be used such that additive fluid is injected into a primary fluid as it passes, for example, through a pipe, since it is not necessary that the primary fluid be dispensed from the injection device itself.

While embodiments of the invention have been described in detail, various modification and other embodiments thereof may be devised by one skilled in the art without departing from the spirit and scope of the invention, as defined in the appended claims.

What is claimed is:

1. A device for injecting additive fluids into a stream of a primary fluid, said device comprising a body having a central bore for flow therethrough of the stream of primary fluid, and a plurality of separate fluid flow channels extending through said body, each said fluid flow channel having an inlet for connection to an associated supply of additive fluid and a plurality of outlet orifices opening into said central bore in equally angularly spaced relationship around an interior perimeter surface of said central bore for emission from said outlet orifices of additive fluid from the associated supply and direction of the emitted additive fluid into the stream of primary fluid flowing through said central bore.

2. The device as in claim 1, wherein said plurality of outlet orifices of each said fluid flow channel lie on a circumference and in a common plane in said central bore.

3. The device as in claim 1, including means for initiating delivery of a selected additive fluid to the inlet to its associated channel for flow through said associated channel to and from said outlet orifices from said channel for direction of the additive fluid into the stream of primary fluid flowing through said central bore.

4. The device as in claim 1, including means for controlling delivery of the selected additive fluid to occur only in response to a flow of the primary fluid through said central bore.

5. A beverage dispenser, comprising a beverage dispensing valve having a nozzle for dispensing a stream of a beverage from said nozzle; and a device for injecting additive fluid flavorings into the stream of beverage, said device comprising a body having a central bore for flow therethrough of the stream of beverage dispensed from said nozzle and a plurality of separate fluid flow channels extending through said body, each said fluid flow channel having an inlet for connection to an associated supply of additive fluid flavoring and a plurality of outlet orifices opening into said central bore in equally angularly spaced relationship around an interior perimeter surface of said central bore for emission from said outlet orifices of additive fluid flavoring from the associated supply of additive fluid flavoring and for direction of the emitted additive fluid flavoring into the stream of beverage flowing through said central bore.

6. The beverage dispenser as in claim 5, wherein said valve nozzle is received in and surrounded by an upper portion of said central bore.

7. The beverage dispenser as in claim 5, wherein said beverage dispenser, is a slush ice dispenser and said valve dispenses from its said nozzle a stream of beverage comprising a stream of slush ice.

8. The beverage dispenser as in claim 5, wherein said plurality of outlet orifices of each said fluid flow channel lie on a circumference and in a common plane in said central bore.

9. The beverage dispenser as in claim 5, including means for initiating delivery of a selected additive fluid to the inlet to its associated channel for flow through said associated channel to and from said outlet orifices from said channel for direction of the additive fluid flavoring into the stream of beverage flowing through said central bore.

10. The device as in claim 5, including means for controlling delivery of the selected additive fluid flavoring to occur only in response to a flow of the beverage through said central bore.

11. A method of injecting additive fluids into a stream of a primary fluid, said method comprising the steps of providing a body having a central bore; forming a plurality of separate fluid flow channels extending through the body, such that each fluid flow channel has at one end an inlet and at an opposite end a plurality of outlet orifices opening into the central bore in equally angularly space relationship around an interior perimeter surface of the central bore; fluid coupling the inlet to each channel to an associated supply of additive fluid; flowing the stream of primary fluid through the central bore; in response to performance of said flowing step, delivering additive fluid from a selected supply thereof to the inlet to the associated channel for flow of the additive fluid through the channel and emission from the outlet orifices from the channel; and directing the additive fluid emitted from the outlet orifices into the stream of primary fluid flowing through the central bore.

12. The method as in claim 11, wherein said plurality of outlet orifices of each fluid flow channel terminate on a circumference and in a common plane in said equally angularly spaced relationship around the interior perimeter surface of the central bore.

13. The method of injecting additive fluid flavorings into a stream of a beverage dispensed from a nozzle of a beverage dispensing valve of a beverage dispenser, said method comprising the steps of providing a body having a central bore; forming a plurality of separate fluid flow channels extending through the body, such that each fluid flow channel has at one end an inlet and at an opposite end a plurality of outlet orifices opening into the central bore in equally angularly spaced relationship around an interior perimeter surface of the central bore; fluid coupling the inlet to each channel to an associated supply of additive fluid flavoring; operating the beverage dispensing valve to flow a stream of the beverage through the central bore; in response to performance of said operating step, delivering additive fluid flavoring from a selected supply thereof to the inlet to the associated channel for flow of the additive fluid flavoring through the channel and emission from the outlet orifices from the channel; and directing the additive fluid flavoring emitted from the outlet orifices into the stream of beverage flowing through the central bore.

14. The method as in claim 13, including the step of positioning the beverage dispensing valve and the body relative to each other so that the nozzle of the beverage dispensing valve extends into an upper end of the body central bore.

15. A device for injecting additive fluids into a stream of a primary fluid, said device comprising a body having a central bore for flow therethrough of the stream of primary fluid, and a plurality of separate fluid flow channels extending through said body, each said fluid flow channel having an inlet for connection to an associated supply of additive fluid and a plurality of outlet orifices opening into said central bore for emission from said outlet orifices of additive fluid from the associated supply and direction of the emitted additive fluid into the stream of primary fluid flowing through said central bore, wherein said body comprises a series of layers, each said layer having a central bore formed therethrough and a fluid flow channel formed in at least one surface thereof and said layers being registered one above the other and sandwiched together to form said body having said central bore and said plurality of separate fluid flow channels extending through said body between said inlets to and said outlet orifices from said channels.

16. A device as in claim 15, wherein facing surfaces of at least two adjacent layers have fluid flow channels formed therein which are complementary to each other and register one with the other to form a fluid flow channel through said body.

17. A beverage dispenser comprising: a beverage dispensing valve having a nozzle for dispensing a stream of a beverage from said nozzle; and a device for injecting additive fluid flavorings into the stream of beverage, said device comprising a body having a central bore for flow therethrough of the stream of beverage dispensed from said nozzle and a plurality of separate fluid flow channels extending through said body, each said fluid flow channel having an inlet for connection to an associated supply of additive fluid flavoring and a plurality of outlet orifices opening into said central bore for emission from said outlet orifices of additive fluid flavoring from the associated supply of additive fluid flavoring and for direction of the emitted additive fluid flavoring into the stream of beverage flowing through said central bore, wherein said body comprises a series of layers, each said layer having a central bore formed therethrough and a fluid flow channel formed in at least one surface thereof and said layers being registered one above the other and sandwiched together to form said body having said central bore and said plurality of separate fluid flow channels extending through said body between said inlets to and said outlet orifices from said channels.

18. The beverage dispenser as in claim 17, wherein facing surfaces of at least two adjacent layers have fluid flow channels formed therein which are complementary to each other and register one with the other to form a fluid flow channel through said body.

* * * * *

UNITED STATES PATENT AND TRADEMARK OFFICE

CERTIFICATE OF CORRECTION

PATENT NO. : 7,159,743 B2
APPLICATION NO. : 10/938329
DATED : January 9, 2007
INVENTOR(S) : Kevin Brandt and E. Scott Sevcik It is certified that error appears in the above-identified patent and that said Letters Patent is hereby corrected as shown below:

Title Page, Item (75) Inventors: "Scott Sevcik" should be --E. Scott Sevcik--

Column 7, line 25, "space" should be --spaced--

Column 8, line 25, "A" should be --The--

Signed and Sealed this

Twenty-fourth Day of April, 2007

JON W. DUDAS
*Director of the United States Patent and Trademark Office*